US011613865B2

(12) United States Patent
Brakman

(10) Patent No.: US 11,613,865 B2
(45) Date of Patent: Mar. 28, 2023

(54) PILE INSTALLING SYSTEM AND A METHOD OF OPERATING THE SYSTEM

(71) Applicant: Fundex Equipment B.V., Middelburg (NL)

(72) Inventor: Johannes Pieter Brakman, Goes (NL)

(73) Assignee: Fundex Equipment B.V., Middelburg (NL)

( * ) Notice: Subject to any disclaimer, the term of this patent is extended or adjusted under 35 U.S.C. 154(b) by 43 days.

(21) Appl. No.: 16/959,999

(22) PCT Filed: Jan. 30, 2019

(86) PCT No.: PCT/NL2019/050052
§ 371 (c)(1),
(2) Date: Jul. 2, 2020

(87) PCT Pub. No.: WO2019/156553
PCT Pub. Date: Aug. 15, 2019

(65) Prior Publication Data

US 2021/0062448 A1 Mar. 4, 2021

(30) Foreign Application Priority Data

Feb. 6, 2018 (NL) ..... 2020381

(51) Int. Cl.
*E02D 7/28* (2006.01)
*E02D 7/26* (2006.01)
(Continued)

(52) U.S. Cl.
CPC ..... *E02D 7/26* (2013.01); *E02D 5/285* (2013.01); *E02D 7/22* (2013.01); *E02D 7/24* (2013.01); *E02D 7/28* (2013.01)

(58) Field of Classification Search
CPC .... E02D 7/28; E02D 7/30; E02D 7/26; E21B 10/44
(Continued)

(56) References Cited

U.S. PATENT DOCUMENTS 2,990,896 A * 7/1961 Kandle ..... E21B 10/44 175/171
3,734,214 A * 5/1973 Benetti ..... E21B 10/44 175/384
4,193,462 A * 3/1980 Blaschke ..... E02D 7/28 175/171
(Continued)

FOREIGN PATENT DOCUMENTS

AT 363044 B 7/1981
DE 3440727 A1 5/1986
(Continued)

OTHER PUBLICATIONS

Machine translation of WO 2014060159, pp. 8 (Year: 2014).*
(Continued)

*Primary Examiner* — Sunil Singh
(74) *Attorney, Agent, or Firm* — N.V. Nederlandsch Octrooibureau

(57) ABSTRACT

A pile installing system for a pile including a cylindrical wall surrounding a hollow space, the system having a central cutter which is locatable at a lower end of the pile for loosening soil below the hollow space upon installing the pile into the ground and which is displaceable within the pile in longitudinal direction thereof so as to remove the central cutter from the pile after installing the pile in the ground, a peripheral cutter locatable at the lower end of the pile for loosening soil below the cylindrical wall, a soil passage for guiding loosened soil from below the cutters to the hollow space, and a soil conveying member for transporting loosened soil upwardly through the hollow space. The soil
(Continued)

passage is located at at least one of the central and peripheral cutter at a radial distance from the cylindrical wall.

19 Claims, 4 Drawing Sheets

(51) Int. Cl.
*E02D 5/28* (2006.01)
*E02D 7/22* (2006.01)
*E02D 7/24* (2006.01)

(58) Field of Classification Search
USPC ..... 405/231–232, 241, 249
See application file for complete search history.

(56) References Cited

U.S. PATENT DOCUMENTS 4,494,613 A 1/1985 Tamaki et al.
6,142,712 A * 11/2000 White ..... E02D 7/28 405/249
6,427,402 B1 * 8/2002 White ..... E02D 5/08 405/241
2013/0294843 A1 * 11/2013 Biserna ..... E02D 7/30 405/249

FOREIGN PATENT DOCUMENTS

JP 2004239014 A 8/2004
WO WO 2014060159 A2 * 4/2014

OTHER PUBLICATIONS

International Search Report and Written Opinion for corresponding International application No. PCT/NL2019/050052; dated May 15, 2019 (9 pages).

* cited by examiner

PILE INSTALLING SYSTEM AND A METHOD OF OPERATING THE SYSTEM

BACKGROUND

Field of the Disclosure

The present invention relates to a pile installing system.

Description of the Related Art

A pile installing system is known from JP 2004-239014. The known system has a cutter edge disc which closes an opening of the lower end of the pile and has an auger drill for upwardly discharging excavated earth and sand. A disadvantage of the known pile installing system is that a lower end of the pile is provided with cutter blades such that the entire pile must be rotated in order to use these cutter blades. Furthermore, removal of the excavated earth and sand from below the pile in upward direction in a manner according to the known system requires much energy.

SUMMARY

An object of the invention is to provide an improved pile installing system.

This object is accomplished with the pile installing system according to the invention, for a pile including a cylindrical wall surrounding a hollow space, the system comprising a central cutter which is located at a lower end of the pile for loosening soil below the hollow space upon installing the pile into the ground and which is displaceable within the pile in longitudinal direction thereof so as to remove the central cutter from the pile after installing the pile in the ground, a peripheral cutter located at the lower end of the pile for loosening soil below the cylindrical wall, a soil passage for guiding loosened soil from below the cutters to the hollow space, and a soil conveying member for transporting loosened soil upwardly through the hollow space, wherein the soil passage is located at at least one of the central and peripheral cutter at a radial distance from the cylindrical wall.

This means that the soil passage is located inside a circumference which is defined by the inner side of the cylindrical wall. Due to the location of the soil passage the loosened soil can move from below the cutters through the soil passage into the hollow space of the pile and further upwardly by the soil conveying member. This requires less energy than passing the loosened soil along an outer side of the peripheral cutter and entering the hollow space at a higher level, since the loosened soil does not have to create a transport path through non-excavated soil at an outer circumference of the peripheral cutter.

When the peripheral cutter excavates soil, such as earth and sand, from below the cylindrical wall of the pile the pile will automatically move downwardly by its own weight or a relatively low thrusting force may be required. The pile can be inserted into the ground without rotating the pile itself. This minimizes the risk of inserting the pile into the ground at an undesired orientation. If a thrusting force is required the power demand will be much less than in case of rotating the pile. The pile installing system according to the invention provides the opportunity of vibration-free pile driving.

After installing the pile in the ground at least the central cutter can be removed from the pile and used for installing a next pile into the ground.

In practice, the cylindrical wall may have a circular cross-section.

In a practical embodiment the central cutter and the peripheral cutter are drivable with respect to the pile about an axis of rotation extending in longitudinal direction of the pile. The axis of rotation may coincide with a centreline of the pile.

Preferably, the central cutter and the peripheral cutter are releasably attachable to each other in at least a rotational direction about the axis of rotation, for example through a bayonet coupling, since only one of the cutters has to be driven under operating conditions.

In a particular embodiment the peripheral cutter is mounted to a lower side of a ring-shaped section, whereas the ring-shaped section has an upper side for supporting the cylindrical wall during installing the pile. The ring-shaped section has two functions: it forms a holder for a peripheral cutter as well as an axial bearing for supporting the pile. After installing the pile in the ground the ring-shaped section including the peripheral cutter remains below the pile. It is noted that more than one peripheral cutter can be mounted to the lower side of a ring-shaped section.

In an advantageous embodiment a tubular bearing portion is fixed to the ring-shaped section, which bearing portion fits inside the pile such that the ring-shaped section including the peripheral cutter can rotate with respect to the pile. In this case the ring-shaped section forms a flange on the tubular bearing portion.

The peripheral cutter may be shaped such that loosened soil is directed towards the axis of rotation upon driving the peripheral cutter, for example the peripheral cutter may comprise a knife blade which has an inwardly curved shape.

The peripheral cutter may extend beyond the outer circumference of the pile such that slightly more soil is excavated than the width of the pile so as to minimize friction between the pile and surrounding soil during inserting the pile into the ground.

The soil passage may be located at the central cutter or between the central cutter and the peripheral cutter.

The soil conveying member may comprise an auger, wherein the central cutter is mounted to a lower end of said auger. The auger may be driven by a driving member, such as an electric motor, a hydraulic motor, or the like. If the peripheral cutter and the central cutter are temporarily coupled to each other during installing the pile the peripheral cutter is indirectly driven by the driving member of the auger.

In a preferred embodiment the pile is provided with coupling members which are configured such that upon engaging cooperating coupling members of another similar pile both piles can be moved with respect to each other in their longitudinal direction, but the piles are interlocked in at least one of rotational direction about the respective axes of rotation and lateral direction. This provides the opportunity to create a secant pile wall comprising a series of interlocked piles.

The coupling members may form a dovetail joint. The dovetail joint may be a rounded dovetail joint which forms a pivot between a pair of interlocked neighbouring piles.

The invention is also related to a method of operating the pile installing system according to one of the preceding claims, wherein the pile is locked in rotational direction about the axis of rotation during operating the central and peripheral cutters. This method provides the opportunity of vibration-free pile driving and accurately inserting a pile into the ground.

BRIEF DESCRIPTION OF THE DRAWINGS

The invention will hereafter be elucidated with reference to very schematic drawings showing an embodiment of the invention by way of example.

DETAILED DESCRIPTION

Figure 1:
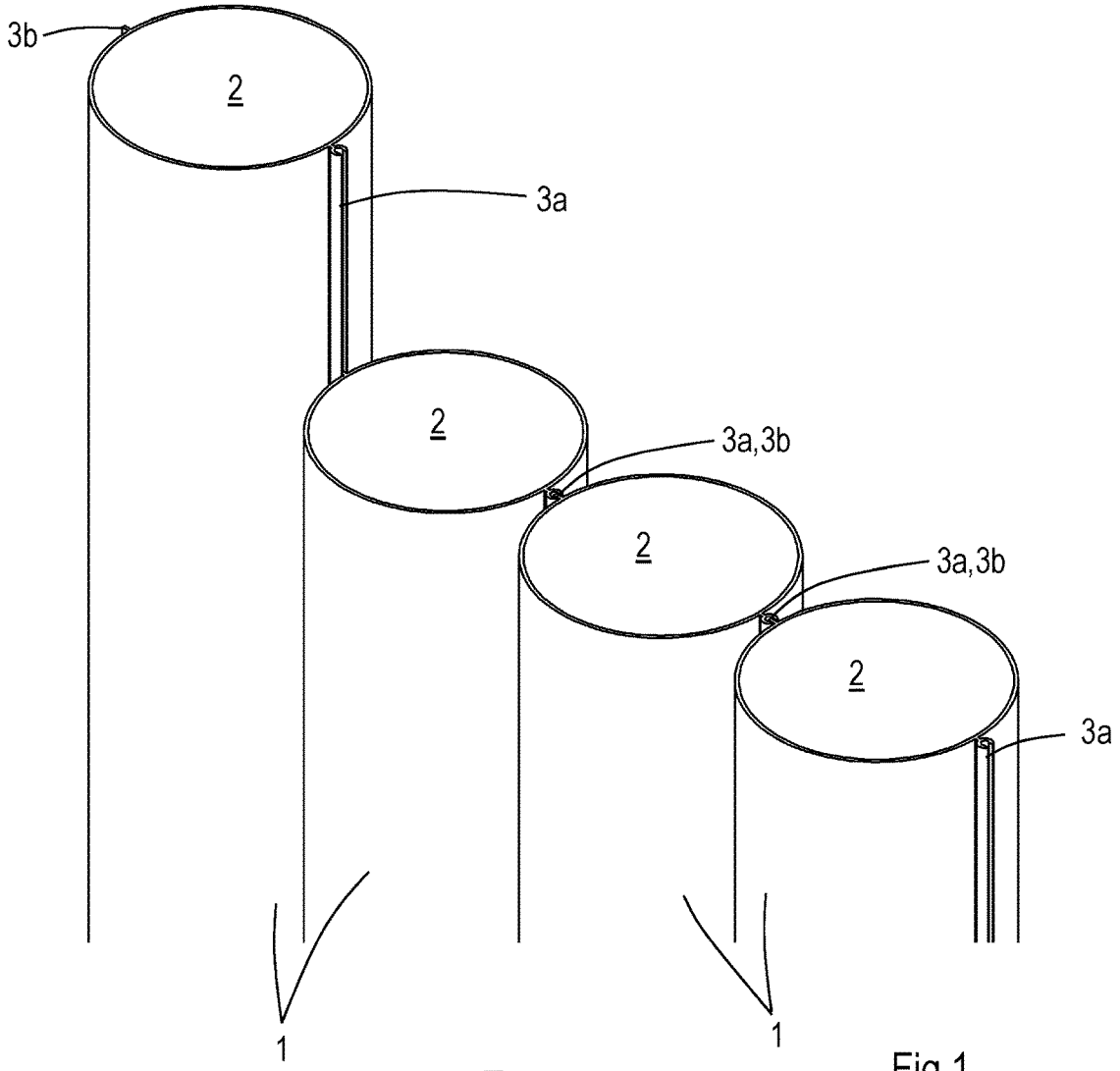
FIG. 1 is a perspective view of a number of piles.
Figure 2:
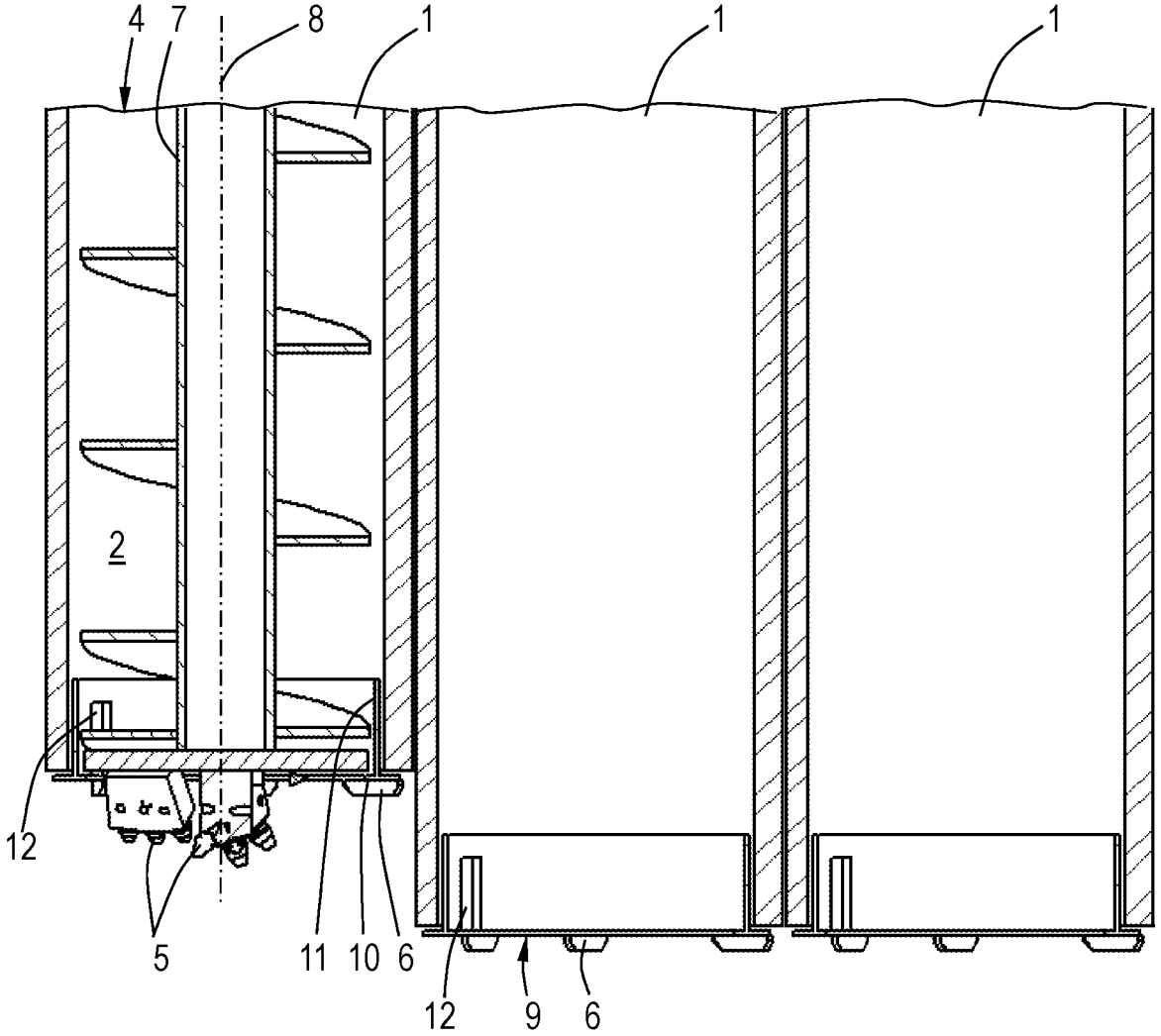
FIG. 2 is a cross-sectional view of a part of the piles as shown in FIG. 1, illustrating one embodiment of a pile installing system according to the invention.
Figure 4:
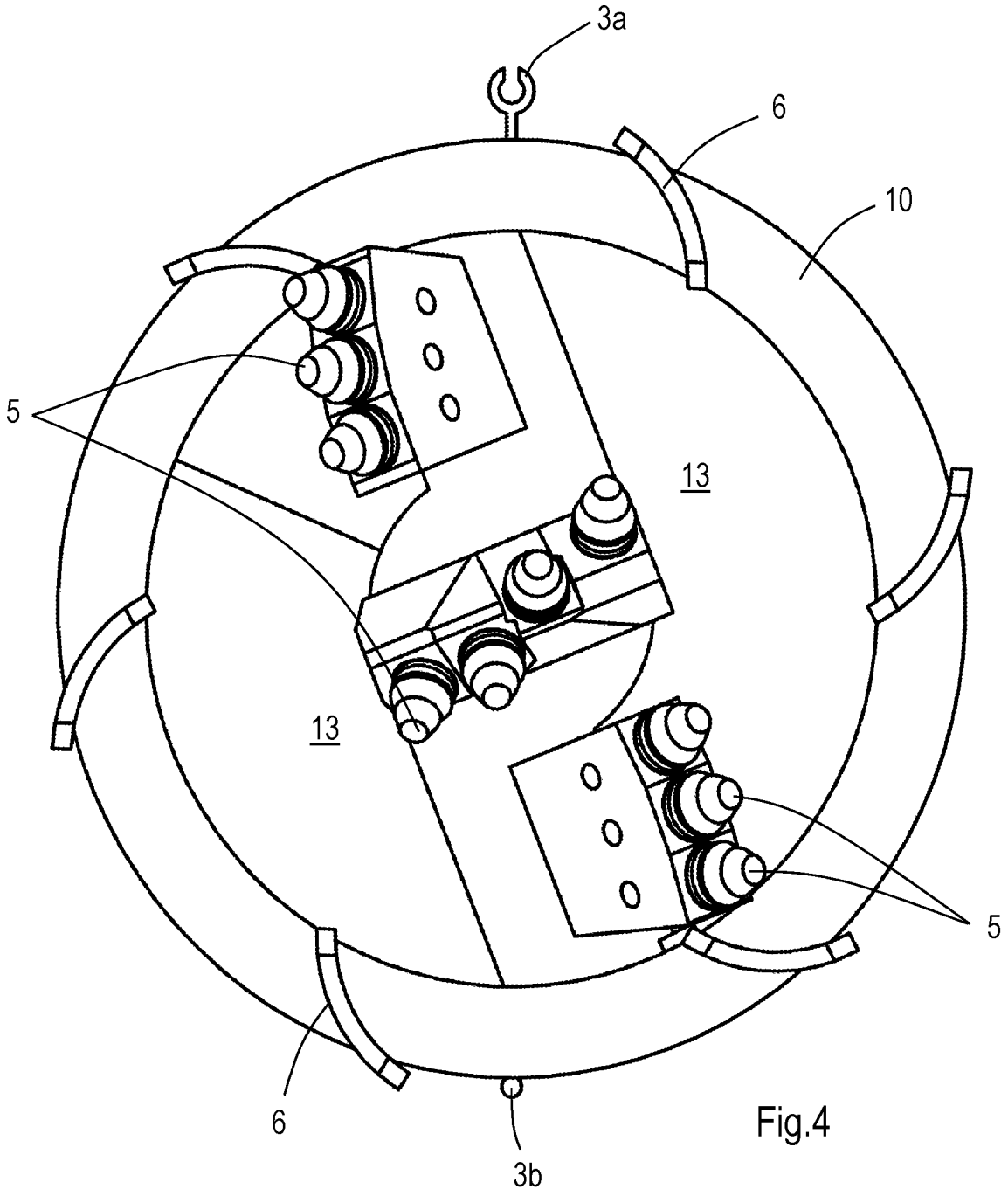
FIG. 4 is a bottom view of the embodiment as shown in FIG. 2.

FIG. 1 shows a row of four piles 1, of which three piles 1 have already been installed in the ground and a fourth pile 1 is being installed and still at a higher position than the other three piles 1. FIG. 2 shows three of the piles 1 in cross-section. Each of the piles 1 has a cylindrical wall including a circular cross-section and surrounding a hollow space 2. The piles 1 may be steel pipes, but alternative materials are conceivable. The piles 1 are installed into the ground without rotating them. FIG. 1 shows that each of the piles 1 has cooperating locking members 3*a*, 3*b* at opposite sides of the pile 1 which allow to interlock two neighbouring piles 1 in lateral direction of the pile when the locking members 3*a*, 3*b* are put into each other in longitudinal direction. The coupling members 3*a*, 3*b* form rounded dovetail joints which means that two neighbouring piles 1 are pivotable with respect to each other, see FIG. 4. The series of piles 1 as shown in FIGS. 1 and 2 form a secant pile wall.

Figure 5:
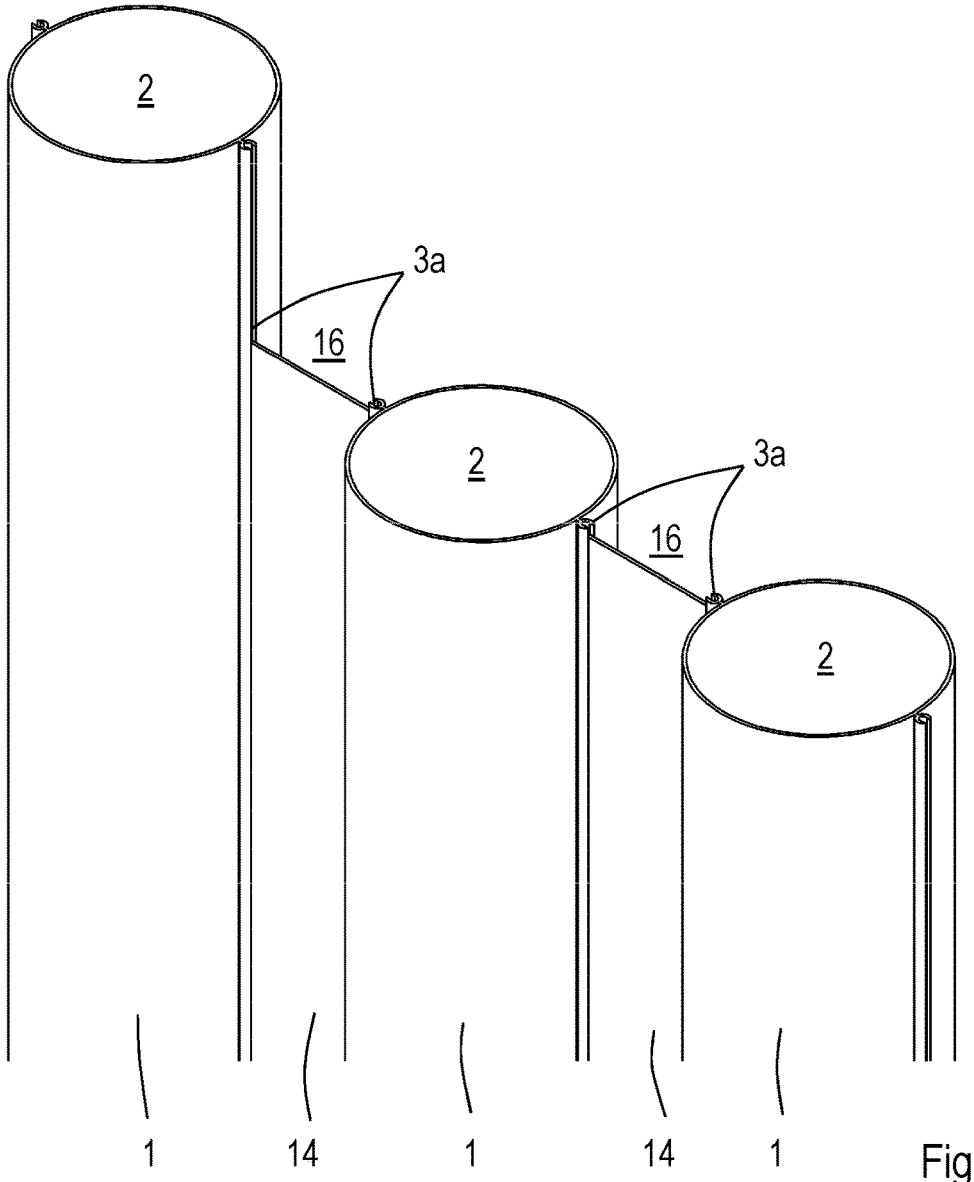
FIG. 5 is a similar view as FIG. 1, but showing an alternative arrangement of the piles.

FIG. 5 shows an alternative arrangement of a secant pile wall in which the piles 1 are installed at a distance from each other, whereas flat sheet plates 14 are placed at openings 16 between the piles 1, forming closures of the openings 16. In this case the piles 1 are provided with locking members 3*a* in which the panels 14 can be slid in vertical direction. The width of the opening 16, as embodied, is about the same as the outer diameter of a pile 1, but the skilled person will appreciate that the opening 16 could be of a different scale than the pile's diameter. It should be noted that the sheet plate 14 is a flat sheet plate, but a different profile sheet plate could be used. The skilled person will appreciate that the secant wall can be provided by means of firstly installing a first pile 1, subsequently installing a second pile 1 at a predetermined distance from the first pile 1, and finally providing the sheet plate 14 in the space 16 between the first and second piles 1 in such a way that the sheet plate 14 slides into the locking members 3*a*. It should be noted that the sheet plate 14 can also be provided after installing the first pile 1 and before installing the second pile 1. In this manner, a more accurate installation of the second pile 1 can be achieved, while providing the secant wall that is designed and constructed to resist the lateral pressure of soil, when there is a desired change in ground elevation that exceeds the angle of repose of the soil.

The leftmost pile 1 of FIG. 2 illustrates an embodiment of a pile installing system 4 according to the present invention. The pile installing system 4 comprises one pile 1, a plurality of central cutters 5 and a plurality of peripheral cutters 6. The pile installing system 4 is also provide with an auger 7. The central cutters 5 and the auger 7 are fixed to other. The auger 7 and the central cutters 5 are driven as a single unit by a driving means (not shown). Under operating conditions they rotate about an axis of rotation 8 which substantially coincides with the centreline of the corresponding pile 1 in this embodiment.

The central cutters 5 are located at a lower end of the pile 1 such that they loosen soil below the hollow space 2 upon installing the pile 1 into the ground. After the pile has reached a desired depth the central cutters 5 can be removed from the pile 1 together with the auger 7, since the central cutters 5 have such dimensions that they are displaceable within the pile 1 in longitudinal direction thereof.

Figure 3:
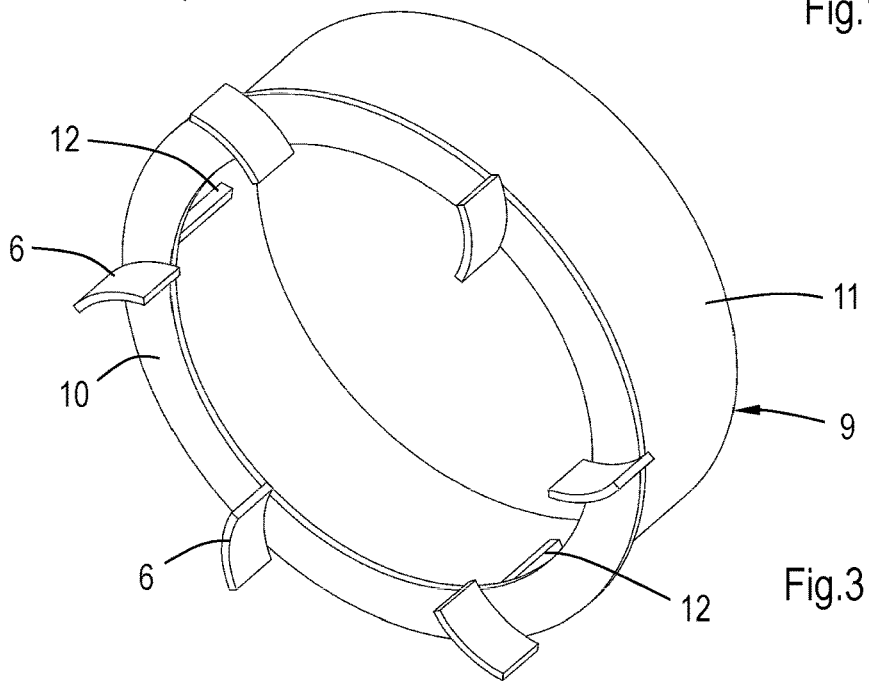
FIG. 3 is an enlarged perspective view of a part of the embodiment as shown in FIG. 2.

The peripheral cutters 6 are part of a ring element 9 which is depicted as a separate part in FIG. 3. In this case there are six peripheral cutters 6, but a different number is conceivable. The peripheral cutters 6 are fixed to a ring-shaped section or flange 10 such that they are located below the cylindrical wall of the pile 1 and extend beyond the outer circumference of the pile 1 during installing the pile 1 into the ground. FIG. 2 shows that the flange 10 supports the pile 1 during installing the pile 1.

The ring element 9 is provided with a tubular bearing portion 11 which fits inside the pile 1 whereas the flange 10 is fixed to the bearing portion 11. The bearing portion 11 comprises a vertical rib 12 at an inner side thereof, which rib 12 cooperates with a notch (not shown) at one of the central cutters 5 or the auger 7 in order to couple the central cutters 5 and the peripheral cutters 6 to each other in rotational direction. The rib 12 allows the central cutters 5 and the peripheral cutters 6 to move with respect to each other in longitudinal direction of the pile 1. This means that after installing the pile 1 in the ground the central cutters 5 can be displaced upwardly with respect to the pile 1 whereas the ring element 9 including the peripheral cutters 6 can stay in the ground. The central cutters 5 and the auger 7 can be used for installing a next pile 1, whereas a new ring element 9 should be applied; this is acceptable since the ring element 9 is a relatively simple and low-cost product.

Figure 6:
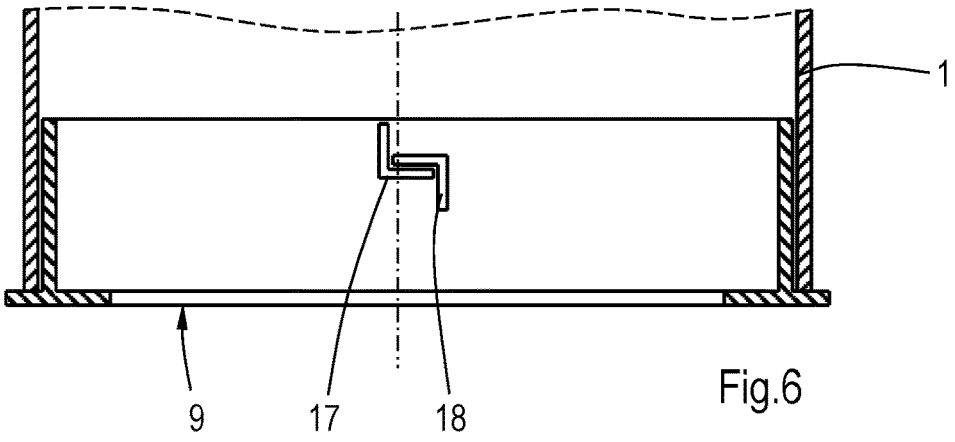
FIG. 6 is an illustrative view of a part of FIG. 2 on a larger scale, but showing an alternative embodiment.

FIG. 6 shows a bayonet coupling between the ring 9 and the auger 7 in an alternative embodiment. In this case an L-shaped element 17 is fixed to an outer surface of the auger 7 and a reversed L-shaped element 18 is fixed to an inner surface of the bearing portion 10 of the ring element 9. These two elements 17 have a perfect operational fit, when in operational status, to couple the central cutters 5 and the peripheral cutters 6 to each other in rotational direction. This will allow certain vertical movement of the bearing portion 11 and the central cutters 5 together while preventing undesired disengagement. After installing the pile 1 the auger 7 and the ring element 9 can be de-coupled from each other in a simple way. The skilled person will appreciate that disengagement of the elements 17, 18 and therefore, of the central cutters 5 and the connection element will occur when the auger 6 counter rotates to enable the elements 17, 18 to disengage.

FIG. 3 shows that the peripheral cutters 6 comprise knife blades which are curved inwardly for guiding loosened soil towards the axis of rotation 8 during installing the pile 1 into the ground.

The pile installing system 4 is provided with soil passages 13 which guide loosened soil, such as sand and earth, from below the cutters 5, 6 to the hollow space 2. In the embodiment as shown the soil passages 13 are located between the central cutters 5 and the peripheral cutters 6 which surround the central cutters 5. When the loosened soil arrives at the hollow space 2 above the cutters 5, 6 it can be transported upwardly through the hollow space 2 by the auger 7.

The pile installing system 4 may be part of a pile driving arrangement comprising a crane vehicle (not shown), for example. The crane vehicle may have a vertical guide along which the pile installing system 4 can slide.

The invention is not limited to the embodiment shown in the drawings and described hereinbefore, which may be varied in different manners within the scope of the claims and their technical equivalents.

The invention claimed is:

1. A pile installing system for a pile including a cylindrical wall surrounding a hollow space, the system comprising:

a central cutter which is locatable at a lower end of the pile for loosening soil below the hollow space upon installing the pile into the ground and which is displaceable within the pile in longitudinal direction thereof so as to remove the central cutter from the pile after installing the pile in the ground, a peripheral cutter locatable at the lower end of the pile for loosening soil below the cylindrical wall, a soil passage for guiding loosened soil from below the central and peripheral cutters to the hollow space, and a soil conveying member for transporting loosened soil upwardly through the hollow space, wherein the peripheral cutter is mounted to a lower side of a ring-shaped section, whereas the ring-shaped section has an upper side for supporting the cylindrical wall during installing the pile, wherein the ring-shaped section including the peripheral cutter can rotate with respect to the pile.

2. The pile installing system according to claim 1, wherein the central cutter and the peripheral cutter are drivable with respect to the pile about an axis of rotation extending in longitudinal direction of the pile.

3. The pile installing system according to claim 2, wherein the central cutter and the peripheral cutter are releasably attachable to each other in at least a rotational direction about the axis of rotation.

4. The pile installing system according to claim 2, wherein the peripheral cutter is shaped such that loosened soil is directed towards the axis of rotation upon driving the peripheral cutter.

5. The pile installing system according to claim 1, wherein a tubular bearing portion is fixed to the ring-shaped section, which bearing portion fits inside the pile such that.

6. The pile installing system according to claim 1, wherein the peripheral cutter extends beyond the outer circumference of the pile.

7. . The pile installing system according to claim 1, wherein the soil passage is located between the central cutter and the peripheral cutter.

8. The pile installing system according to claim 1, wherein the soil conveying member comprises an auger, wherein the central cutter is mounted to a lower end of said auger.

9. The pile installing system according to claim 1, wherein the pile is provided with coupling members which are configured such that, upon engaging cooperating coupling members of another similar pile both piles can be moved with respect to each other in their longitudinal direction, but the piles are interlocked in at least one of rotational direction about the respective axes of rotation and lateral direction.

10. The pile installing system according to claim 9, wherein the coupling members form a dovetail joint.

11. The pile installing system according to claim 1, wherein the central cutter and the peripheral cutter are releasably attachable to each other through a bayonet coupling.

12. A method of operating a pile installing system comprising a cylindrical wall surrounding a hollow space, a central cutter positionable at a lower end of the pile and displaceable within the pile in longitudinal direction, a peripheral cutter mounted to a lower side of a ring-shaped section and locatable at a lower end of the pile, the ring-shaped section having an upper side for supporting the cylindrical wall, a soil passage for guiding loosened soil from below the cutters to the hollow space, and a soil conveying member for transporting loosened soil upwardly through the hollow space, the method comprising:

locking the pile in rotational direction about the axis of rotation; and operating the central and peripheral cutters, wherein the ring-shaped section including the peripheral cutter can rotate with respect to the pile.

13. The method of claim 12, wherein the step of locking the pile in a rotational direction about the axis of rotation comprises using one or more locking members to connect to the pile.

14. The method of claim 13, wherein the one or more locking members comprise a member to lock the pile to a neighbouring pile.

15. A pile installing system for installing a pile comprising a cylindrical wall surrounding a hollow space, the system comprising:

a central cutter which is locatable at a lower end of the pile and which is displaceable within the pile in a longitudinal direction thereof;

a peripheral cutter locatable at the lower end of the pile, the peripheral cutter mounted to a lower side of a ring-shaped section with an upper side for supporting the cylindrical wall during installation;

a soil passage for guiding loosened soil from below the cutters to the hollow space; and a soil conveying member for transporting loosened soil upwardly through the hollow space, wherein the ring-shaped section including the peripheral cutter can rotate with respect to the pile.

16. The pile installing system of claim 15, wherein a tubular bearing portion is fixed to the ring-shaped section, the bearing portion configured to fit inside the pile.

17. The pile installing system according to claim 15, wherein the peripheral cutter is shaped such that loosened soil is directed towards an axis of rotation upon driving the peripheral cutter and/or wherein the peripheral cutter extends beyond the outer circumference of the pile.

18. The pile installing system according to claim 15, wherein the soil conveying member comprises an auger.

19. The pile installing system according to claim 15, wherein the central cutter and the peripheral cutter are releasably attachable to each other.

* * * * *